US008371954B1

(12) United States Patent
Anderson

(10) Patent No.: US 8,371,954 B1
(45) Date of Patent: Feb. 12, 2013

(54) GOLF SWING INSTRUCTION TOOL UTILIZING A MOTION TRAINING SCHEMATIC

(76) Inventor: Gary Anderson, Yalaha, FL (US)

( * ) Notice: Subject to any disclaimer, the term of this patent is extended or adjusted under 35 U.S.C. 154(b) by 0 days.

(21) Appl. No.: 13/487,383

(22) Filed: Jun. 4, 2012

(51) Int. Cl.
*A63B 69/36* (2006.01)

(52) U.S. Cl. ..... 473/218; 473/273

(58) Field of Classification Search ..... 473/218, 473/219, 257, 261, 262, 264, 265, 266, 268, 473/270, 273, 278, 279
See application file for complete search history.

(56) References Cited

U.S. PATENT DOCUMENTS

| | | | | |
|---|---|---|---|---|
| 4,544,160 | A * | 10/1985 | Miner | 473/218 |
| 4,620,708 | A * | 11/1986 | Meyer et al. | 473/265 |
| 4,718,674 | A * | 1/1988 | Henry | 473/218 |
| 5,246,233 | A * | 9/1993 | Sheltman et al. | 473/265 |
| 5,984,801 | A * | 11/1999 | Mason | 473/270 |
| 7,131,910 | B2 * | 11/2006 | Townsend, II | 473/278 |
| 7,597,632 | B2 * | 10/2009 | Edwards et al. | 473/265 |

* cited by examiner

*Primary Examiner* — Nini Legesse
(74) *Attorney, Agent, or Firm* — Daniel Law Office, P.A.; Jason T. Daniel, Esq.

(57) ABSTRACT

A golf swing instruction tool for positioning a golfer in accordance with a golf schematic representing a preferred golf swing includes an elongated shaft having a plurality of sides, a series of ball position circles, a pair of stance lines, a plurality of posture sight lines, a takeaway sight line, a downswing sight line, and a follow through sight line.

12 Claims, 4 Drawing Sheets

GOLF SWING INSTRUCTION TOOL UTILIZING A MOTION TRAINING SCHEMATIC

BACKGROUND

1. Field of the Invention

The present invention relates generally to golf instruction, and more particularly to a physical alignment tool for instructing a user to properly swing a golf club utilizing a motion training schematic.

2. Description of the Related Art

The game of golf is one of the most difficult sports to master. In order to become proficient, players must learn to swing a golf club while maintaining proper body positioning, hand placement, club alignment and more. In this regard, golfers ranging from novice to professional often turn to professional instructors or commercially available products in order to analyze and correct swing mechanics.

In many sports players have identification marks such as hash marks, side lines, base lines, arcs, free-throw lines, batters boxes, etc., which allow players of those sports to identify their position. However, in the game of golf, such identification marks are not allowed during actual game play. As a result, it is imperative to train and develop muscle memory utilizing correct sight lines in order to learn and improve proper golf swing mechanics.

One particularly innovate method of instruction is described in co-pending United States Patent Publication No. 2012-0040137, to Anderson, the contents of which are incorporated herein by reference. The '137 document relates to golf instruction wherein the golfer is positioned within a virtual schematic having multiple sight lines for positioning and maintaining the golfers' body in a preferred position before, during and after a golf swing.

FIG. 1 illustrates the golf schematic 10 in accordance with the '137 document which can be used to maintain proper positioning during all aspects of a golf swing such as the Setup, Takeaway, Upswing, Position at the top, Downswing, Impact, Follow through, and Finish. As shown, the schematic 10 includes two vertical lines identified as a target line 11 and a posture line 12, two diagonal lines identified as a swing plane 13 and a body plane 14 and a circular line identified as a posture circle 15. The target line 11 represents the projected path a golf ball will travel when struck by the golfer. The posture line 12 represents the preferred core body positioning of the golfer. The swing plane 13 represents the lower boundary of the swing movement of the golfer. The body plane 14 represents both the upper boundary of the swing movement of the golfer and the preferred upper body position of the golfer. Finally, the posture circle represents the preferred position of the head of the golfer. As shown, each element of the schematic 10 is positioned at a specific location and angle with respect to the other elements. As such, the bottom end of the target line 11 is connected to the bottom end of the swing plane 13 at a 45° angle. The posture line 12 is positioned parallel to the target line 11 and is intersected at the mid point by the swing plane 13 at a 45° angle. The body plane is positioned parallel to the swing plane 13 and is connected to the top of the posture line at a 45° angle. Finally, the posture circle 14 is positioned at the top of the posture line 12 nearest to the target line 11. This position and the identified angles act to ensure that a student golfer is maintaining proper body positioning at all times both before, during and after the golf swing.

The '137 document utilizes a video and/or camera system to superimpose the schematic onto a rendering of the golfer, and to record the golfers swing which can be immediately viewed by an instructor, and subsequently reviewed by the golfer after completing their golf swing.

Accordingly, it would be beneficial to introduce a golf swing instruction tool having a plurality of indication markers that correspond to the above mentioned golf schematic which can be utilized directly by the golfer during all aspects of a golf swing.

SUMMARY OF THE INVENTION

The present invention is directed to a golf swing instruction tool for positioning a golfer in accordance with a golf schematic representing a preferred golf swing. One embodiment of the tool can include an elongated shaft having a plurality of sides, a series of ball position circles, a pair of stance lines, a plurality of posture sight lines, a takeaway sight line, a downswing sight line, and a follow through sight line.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. further, the terms and phrases used herein are not intended to be limiting but rather to provide an understandable description of the invention.

The golf swing instruction tool utilizing a motion training schematic can be used as an aid for learning proper technique and muscle memory that is required to excel in golf. Although illustrated with particular reference to a right handed golfer, the inventive steps can also be utilized by a left handed golfer without deviating from the invention.

By systematically studying, recording and mapping the swing characteristics of a plurality of world-recognized professional golfers and golf instructors over a period of several years, the inventor has discovered a number of characteristics that are common to each. Based on these observations, ideal body positions and boundaries (as determined by the aggregate position of the above noted golfers) were identified and a golf schematic was created. As used herein, a golf schematic includes a mathematical compilation of ideal body positions, and a plurality of corresponding lines at identified angles used to connect each of these positions into a single map (schematic) representing the parameters for a fundamentally ideal golf swing.

To this end, and as will be explained in greater detail below, when a golfer performs a golf swing in accordance with the schematic, the ball will travel to the target area. Alternatively, when a golfer deviates from the schematic during a golf swing, the golf ball will deviate in a predictable manner that corresponds to the deviation from the schematic.

Figure 2:
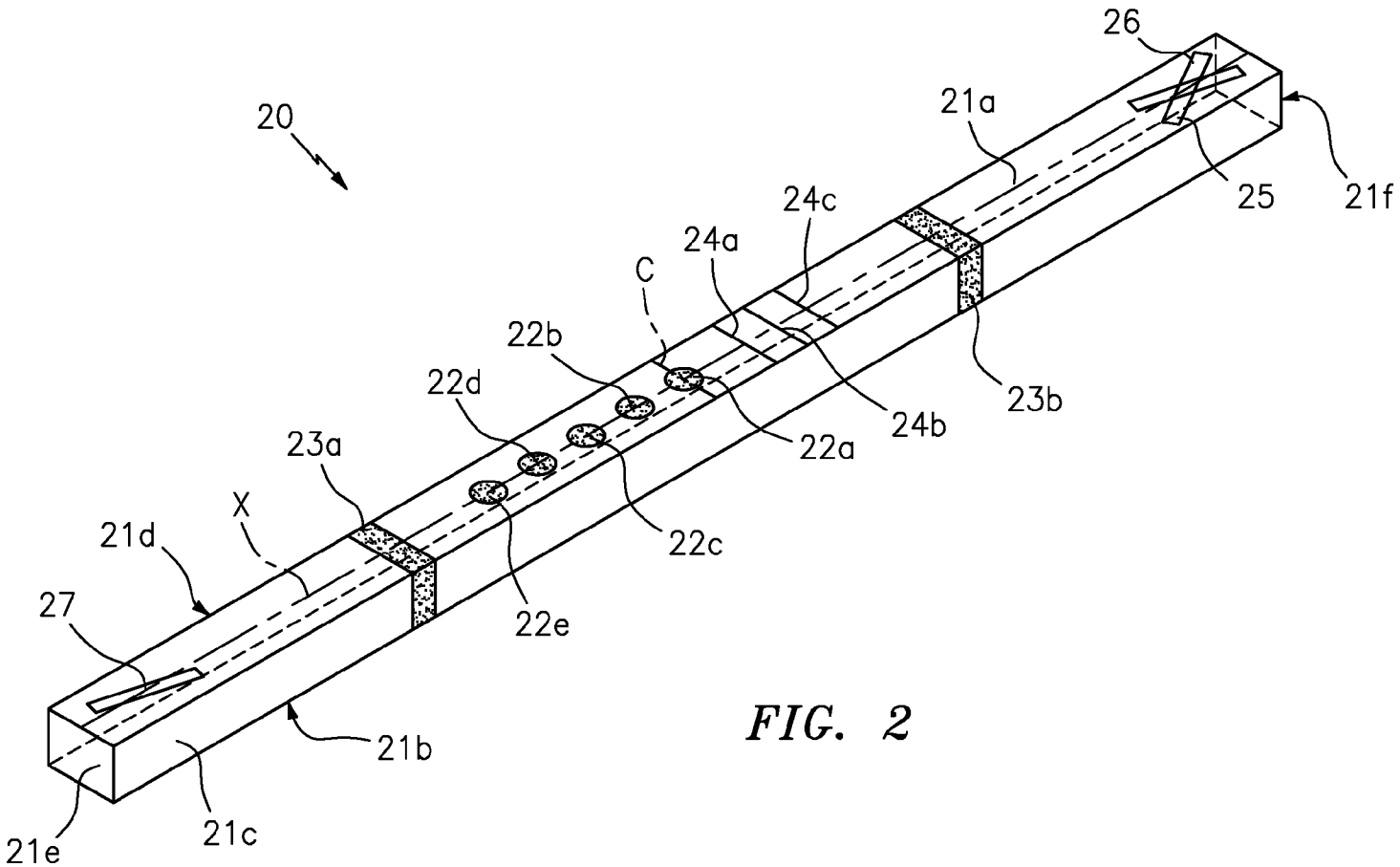
FIG. 2 is a perspective view of the golf swing instruction tool, in accordance with one embodiment of the present invention.

FIG. 2 illustrates one embodiment of a golf swing instruction tool 20 that is useful for understanding the inventive concepts disclosed herein. As shown, the tool can include a generally planar elongated shaft 21 having a top surface 21*a*, a bottom surface 21*b*, a front side surface 21*c*, a back side surface 21*d*, a first end 21*e* and a second end 21*f*.

In one preferred embodiment, the elongated shaft 21 can include a length (X axis) of approximately 4 feet 9 inches, a width (21*c* to 21*d*) of approximately 1½ inches, and a height (21*a* to 21*b*) of approximately ¾ inches. The shaft will be constructed from a sturdy material such as wood, PVC, or plastic, for example, having excellent durability and tensile strength, and will preferably include a vibrant color, such as bright white, for example, that does not easily blend into the surrounding landscape in order to allow a user to easily maintain eye contact with the tool.

As shown, a plurality of markings 22-27 can be displayed on the surface of the tool. Each of these markings correspond to the various components of the golf schematic 10 in order to allow a user to align themselves within the schematic and detect variations from the same, during an actual golf swing. To this end, the tool 20 can be utilized during practice or during actual game play in order to allow the user to play within the schematic boundaries at all times.

In one embodiment, the shaft can include five ball position circles 22*a*-22*e* that are imprinted onto the top surface 21*a* of the elongated shaft. In one preferred embodiment, each of the ball position circles will include a diameter of approximately 1" with ball position circle 22*a* located at the center line C of the shaft length, and each remaining circle being positioned linearly on the top surface towards the first end 21*e* at a distance of approximately ¾".

The ball position circles 22 act in conjunction with the other markings to identify correct ball placement based on the type of golf club the user will be hitting. To this end, ball position circle 22*a* will be used to identify proper ball placement when a user is hitting a 6 iron or a sand wedge. Ball position circle 22*b* is used to identify proper ball placement for users hitting a 5 iron, 9 wood, 7 wood, 5 wood or a 5 hybrid. Ball position circle 22*c* is used to identify proper ball placement for users hitting a 4 iron, 5 wood or a 4 hybrid. Ball position circle 22*d* is used to identify proper ball placement for users hitting a 3 iron, 3 wood, or a 3 hybrid. Finally, ball position circle 22*e* is used to identify proper ball placement for users hitting a driver or a 3 wood.

The stance lines 23 are used to indicate the proper location for the user's feet during a golf swing. In one embodiment, each stance line 23 can include an elongated rectangular marking that is imprinted onto each of the top 21*a*, front 21*c* and back 21*d* sides of the shaft. As shown, stance lines 23*a* will preferably be positioned at a distance of approximately 16½ inches to the right of the first end 21*e*, and stance line 23*b* will preferably be positioned at a distance of approximately 16½ inches to the left of the second end 21*f* along the X axis.

Figure 3:
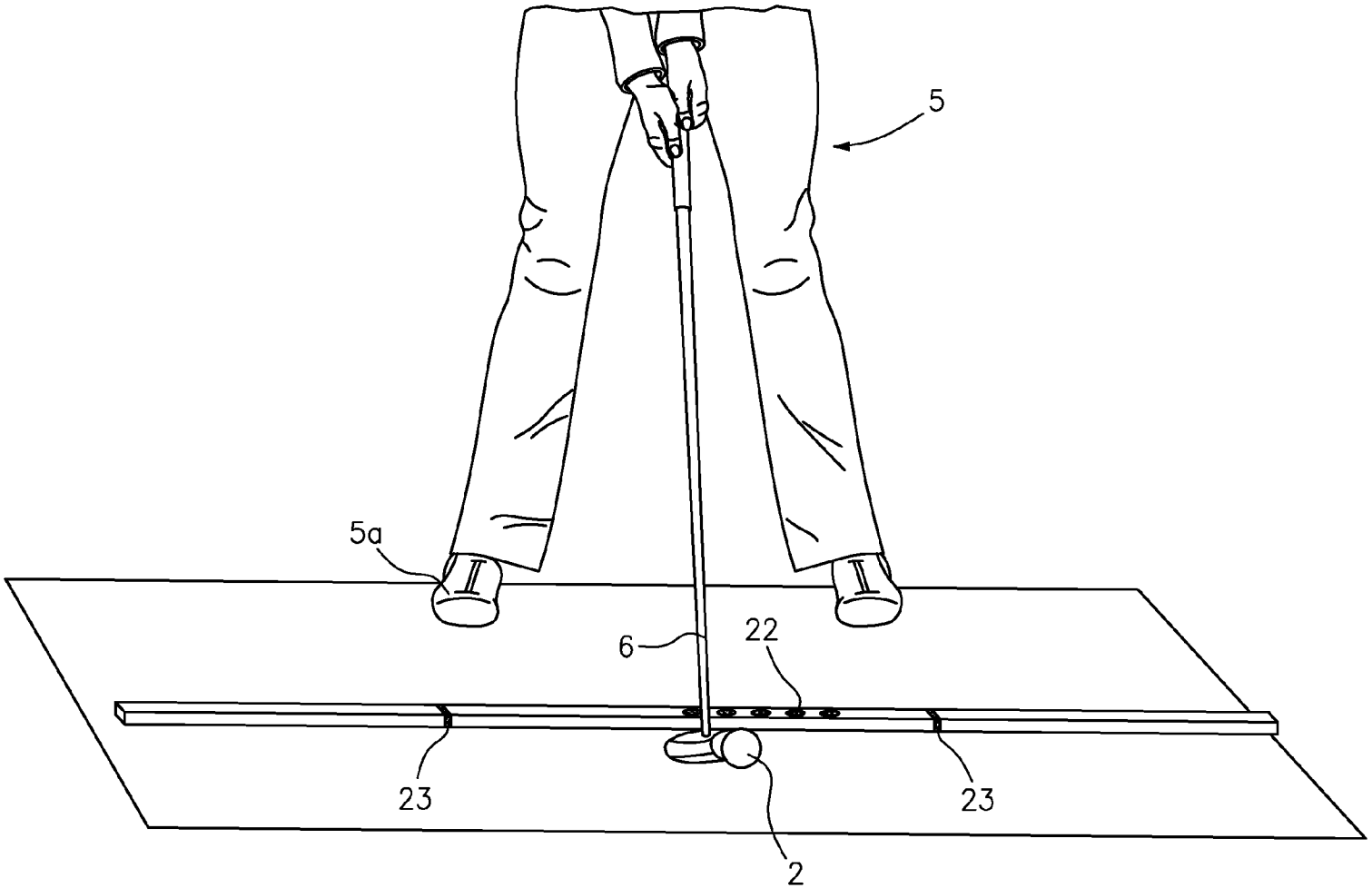
FIG. 3 is a front view of a golfer using the tool in a setup position, in accordance with one embodiment of the present invention.

As shown in FIG. 3, once a user 5 has selected the desired club 6, he/she can place a golf ball 7 onto the ground at a location that is approximately 6-10 inches (depending on the height of the golfer) away from the back surface 21*d* of the shaft 20 and at a perpendicular angle to the ball position circle 22*a*-22*e* corresponding to the selected club. Next, the user will enter the Setup Position by aligning their feet 5*a* adjacent to the front side 21*c* of the shaft at a location that is next to the stance lines 23. As will be shown below, when in this position, the user will be aligned with the posture line 12 of the schematic.

A pair of posture sight lines 24*a* and 24*b* are imprinted onto the top surface 21*a* of the shaft, and act to provide a visual line-of-sight reference to the golfer during a golf swing. In one preferred embodiment, posture sight line 24*a* can be located approximately 1.5" from the centerline C (towards the second end 21*f*) and each posture sight line 24*b* can be positioned approximately 1½ inches from line 24*a*.

In operation, once a user is at the Setup Position, and looking directly at the golf ball, the user will identify the posture sight line 24*a* or 24*b* that is at the outermost periphery of their vision (i.e. in a direction away from the center line C). By identifying the outermost posture sight line at the Setup Position, and maintaining the line in the peripheral vision throughout a golf swing, the user will be immediately able to recognize excessive head movement when either the identified posture sight line disappears from view, or another posture sight line comes into view. In either of these situations, the users head will have traveled outside of the posture circle 15 identified by the schematic 10.

Figure 4:
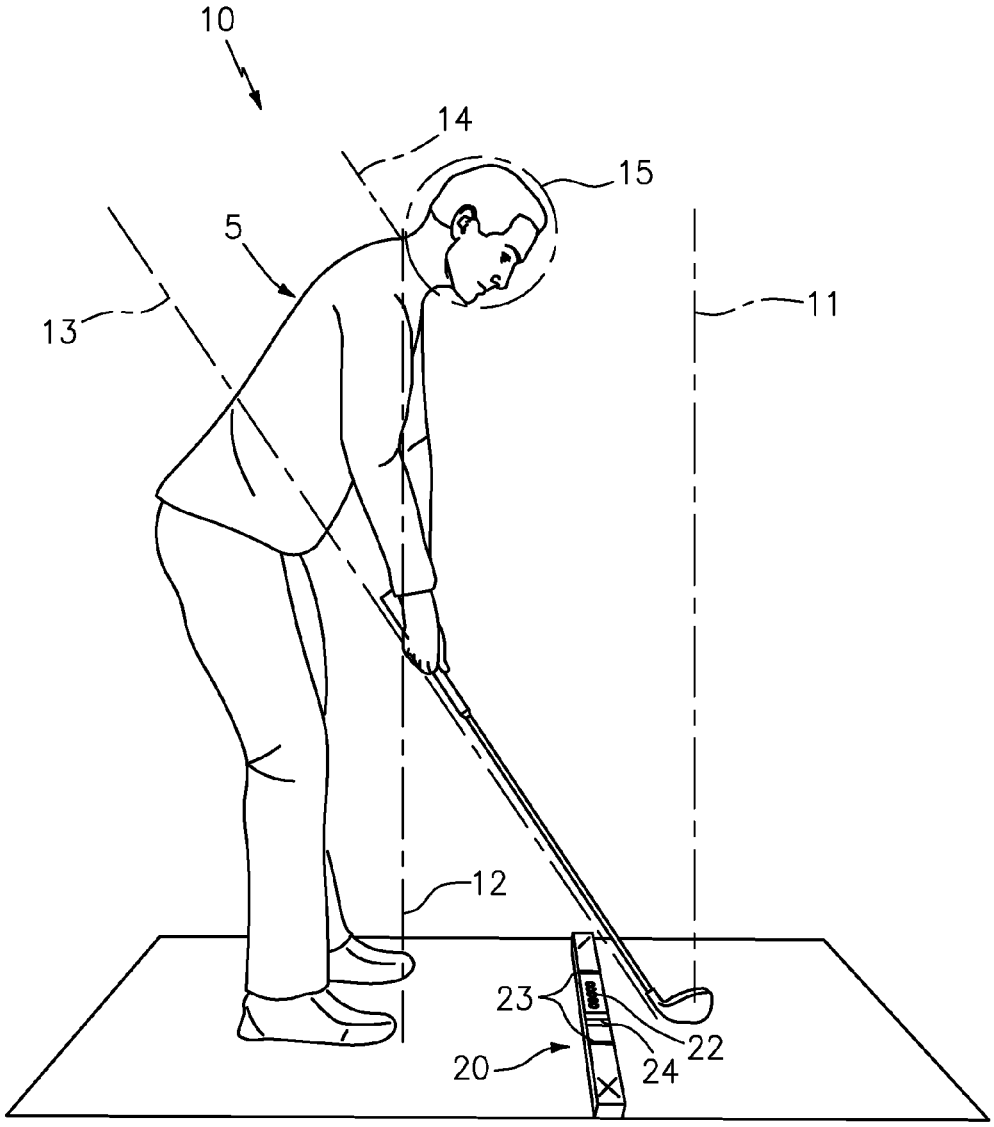
FIG. 4 is a side view of a golfer using the tool in a setup position, in accordance with one embodiment of the present invention.

As shown in FIG. 4, when the tool 20 is positioned parallel to the target area indicated by the target line 11 of the schematic, the ball position circles 22 and the stance lines 23 work in unison to align the golfer 5 with the posture line 12 of the schematic. Likewise, the posture sight lines 24*a* and 24*b* work to keep the golfers upper body in line with the body plane 14 and the posture circle 15 of the schematic.

The takeaway sight line 25 indicates the path which the golf club should travel during a backswing, and includes a single diagonal line having a length of approximately 6 inches that is located approximately ¾ inches from the second end 21*f*. The line 25 is positioned on the top surface 21*a* of the shaft and radiates toward the back side 21*d* at an approximately 15° angle with respect to the front side 21*c*.

The downswing sight line 26 indicates the path which the golf club should travel during a downswing, and also includes a single diagonal line having a length of approximately 6 inches that is located approximately ¾ inches from the second end 21*f*. The line 26 is positioned on the top surface 21*a* of the shaft and radiates toward the front side 21*c* at an approximately 15° angle with respect to the back side 21*d*.

The follow through sight line 27 indicates the path which the golf club should travel during a follow through swing, and includes a single diagonal line having a length of approximately 6 inches that is located approximately ¾ inches from the first end 21*f*. The line 27 is positioned on the top surface 21*a* of the shaft and radiates toward the front side 21*c* at an approximately 15° angle with respect to the back side 21*d*.

Figure 1:
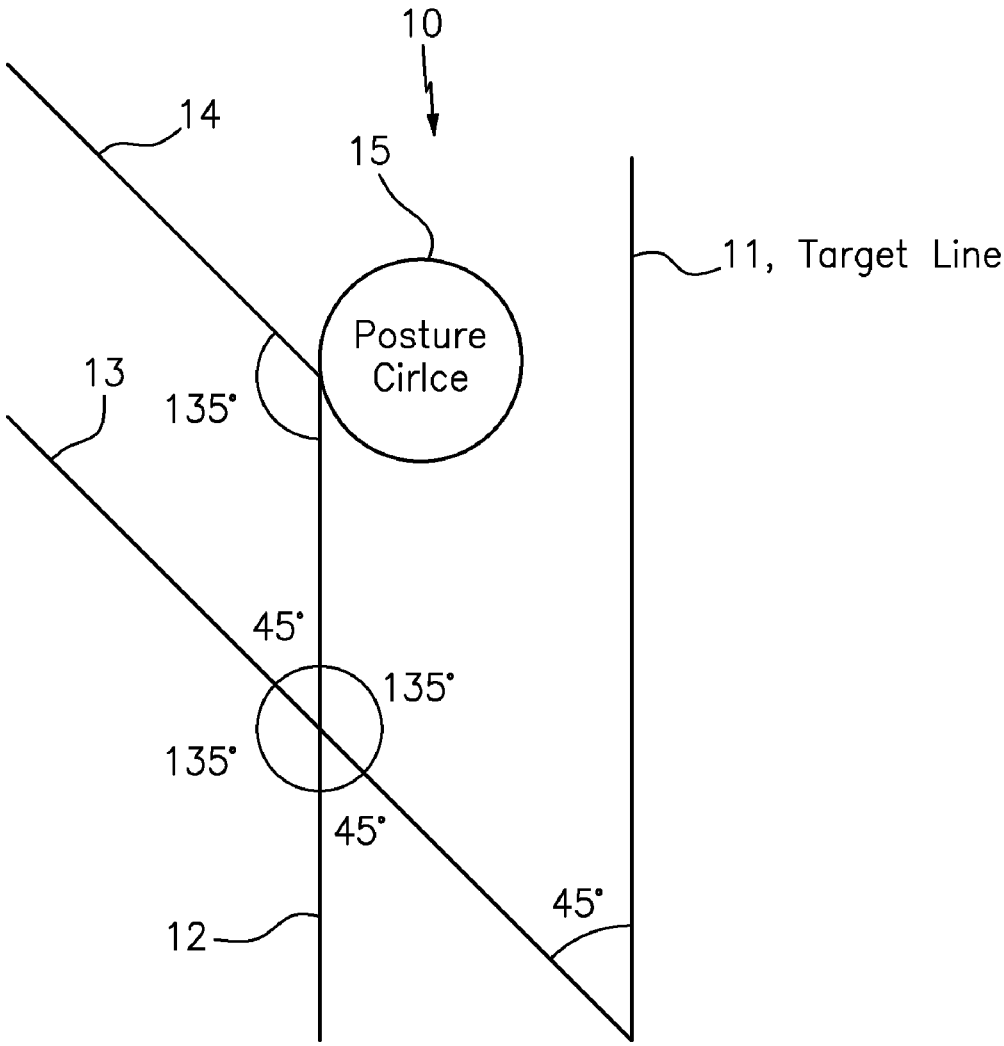
FIG. 1 Background Art
FIG. 1 is a background illustration of a golf schematic that is useful for understanding the inventive concepts disclosed herein.

As shown, each of the takeaway line 25 and downswing line 26 overlap to form a pair of opposing 45° angles and a pair of 135° angles with respect to each other. These angles correspond to the angles used to define the relationship of the posture line 12, and the swing plane 13 of the golf schematic 10, as shown in FIG. 1.

When utilized together throughout a golf swing, each of the takeaway line 25, downswing line 26 and follow through line 27 act to keep a golfers swing on path with the swing plane 13 of the schematic 10.

To this end, if the path of the golfers swing deviates from any of the lines 25-27 the golfer and/or instructor will have an instant visual cue that can be corrected immediately, without the need for reviewing a recorded image of the swing.

Although described above with regard to specific shapes (i.e., circular marks, rectangular marks, etc.,) this is for illustrative purposes only, as any number of distinct shapes can be utilized to identify each of the above noted marks 22-27. Moreover although described above as being imprinted onto the shaft, one of skill in the art will recognize that the above described marks can be secured to the shaft in any number of different ways such as through ink/dyes, by etching the surface to form the above described shapes and/or by securing the marks to the shaft via adhesive materials such as glue or resin, for example.

As described herein, one or more elements of the golf instruction tool 10 can be secured together utilizing any number of known attachment means such as, for example, screws, glue, compression fittings and welds, among others. Moreover, although the above embodiments have been described as including separate individual elements and markings, the inventive concepts disclosed herein are not so limiting. To this end, one of skill in the art will recognize that one or more individual elements such as the markings 22-27 and the shaft 21, for example, may be formed together as one continuous element, either through manufacturing processes, such as welding, casting, or molding, or through the use of a singular piece of material milled or machined with the aforementioned components forming identifiable sections thereof. Accordingly, in one preferred embodiment, each above described element of the golf instruction tool 10 can be constructed from a single mold of injected plastic having the markings and dimensions specified above; however other materials such as metal and rigid plastic are also contemplated.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A golf swing instruction tool for positioning a golfer in accordance with a golf schematic representing a preferred golf swing, the schematic including a target line, a posture line, a swing plane, a body plane and a posture circle, and said tool comprising:

an elongated shaft having a front side, a back side, a top surface, a bottom surface a first end and a second end;

a plurality of ball position circles positioned on the top surface of the shaft, each of said ball position circles being configured to identify a preferred location for placing a golf ball;

a first and second stance line positioned on the top surface, the front surface and the back surface of the shaft, said stance lines being configured to indicate a proper foot spacing to align a user with the posture line of the schematic;

a plurality of posture sight lines positioned on the top surface of the shaft, each of said posture sight lines being configured to act as a line-of-sight reference to a user;

a takeaway sight line positioned on the top surface of the shaft adjacent to the second end, said takeaway sight line being configured to indicate a preferred path for a golf club to travel during a backswing;

a downswing sight line positioned on the top surface of the shaft adjacent to the second end, said downswing sight line being configured to indicate a preferred path for a golf club to travel during a downswing, and said downswing sight line having an inverse relationship with said takeaway sight line; and a follow through sight line positioned on the top surface of the shaft adjacent to the first end, said follow through sight line being configured to indicate a preferred path for a golf club to travel during a follow through swing.

2. The tool of claim 1, wherein a location of the shaft is configured to correspond to target line of the schematic, the ball position circles and the stance lines are configured to align a user with the posture line of the schematic, and the posture sight lines are configured to alight a users upper body with each of the body plane and the posture circle of the schematic.

3. The tool of claim 1, wherein the shaft includes a length of 4 feet 9 inches, a height of ¾ inches, and a width of 1½ inches.

4. The tool of claim 1, wherein the shaft is constructed from at least one of wood, PVC and plastic having a vibrant color configured to stand out from a surrounding landscape.

5. The tool of claim 1, wherein said plurality of ball position circles includes a first ball position circle configured to identify proper ball placement for a 6 iron and a sand wedge;

a second ball position circle configured to identify proper ball placement for a 5 iron, a 9 wood, a 7 wood, a 5 wood and a 5 hybrid;

a third ball position circle configured to identify proper ball placement for a 4 iron, a 5 wood, and a 4 hybrid;

a fourth ball position circle configured to identify proper ball placement for a 3 iron, a 3 wood, and a 3 hybrid; and a fifth ball position circle configured to identify proper ball placement for a driver and a 3 wood golf club.

6. The tool of claim 5, wherein said first ball position circle is positioned along a center portion of the shaft surface, and each of the remaining ball position circles are disposed along the top surface at ¾ inch intervals towards the first side.

7. The tool of claim 6, wherein said first stance line is located 16.5 inches from the first end of the shaft and the second stance line is located 16.5 inches from second end of the shaft.

8. The tool of claim 1, wherein said plurality of posture sight lines comprises:

a first posture sight line positioned 1.5 inches from a center length of the shaft; and a second, posture sight line disposed along the top surface at distance of 1.5 inchs towards the second side of the shaft.

9. The tool of claim 1, wherein said takeaway sight line includes a single diagonal line positioned adjacent to the second end of the shaft.

10. The tool of claim 1, wherein said downswing sight line includes a single diagonal line positioned adjacent to the second end of the shaft.

11. The tool of claim 1, wherein said follow through sight line includes a single diagonal line positioned adjacent to the first end of the shaft.

12. The tool of claim 1, wherein said takeaway sight line and said downswing sight line are positioned at angles corresponding to reciprocal angles of the posture line and the swing plane of the schematic.

* * * * *